United States Patent [19]

Gamberini

[11] Patent Number: 4,559,758

[45] Date of Patent: Dec. 24, 1985

[54] CIGARETTE PACKING MACHINE

[75] Inventor: Antonio Gamberini, Bologna, Italy

[73] Assignee: G.D Societa' per Azioni, Bologna, Italy

[21] Appl. No.: 563,819

[22] Filed: Dec. 21, 1983

[30] Foreign Application Priority Data

Feb. 8, 1983 [IT] Italy ..... 3332 A/83

[51] Int. Cl.[4] ..... B65B 11/28; B65B 19/02

[52] U.S. Cl. ..... 53/207; 53/53; 53/234

[58] Field of Search ..... 53/53, 170, 207, 234, 53/236, 387, 444

[56] References Cited

U.S. PATENT DOCUMENTS 3,517,477 6/1970 Thornton ..... 53/53
3,956,870 5/1976 Kruse et al. ..... 53/234 X
4,144,695 3/1979 Seragnoli ..... 53/234
4,265,073 5/1981 Seragnoli ..... 53/234 X

*Primary Examiner*—Robert L. Spruill
*Assistant Examiner*—Michael D. Folkerts
*Attorney, Agent, or Firm*—Marshall, O'Toole, Gerstein, Murray & Bicknell

[57] ABSTRACT

Machine for packing cigarettes in hard, flip-top packets on which the packets are made by folding die-cut pieces round preformed groups of cigarettes on a folding wheel turning round a horizontal axis; on which the packets are then sent to a final drying wheel turning round a horizontal axis essentially perpendicular to the axis of the said folding wheel; on which the packets are then shifted axially in relation to the drying wheel and unloaded off the latter on to an essentially horizontal output conveyor the axis of which is essentially parallel to the rotation axis of the drying wheel.

8 Claims, 3 Drawing Figures

CIGARETTE PACKING MACHINE

BACKGROUND OF THE INVENTION

The present invention relates to a machine for packing cigarettes in hard, flip-top packets. Of known types of the above machine, one comprises a wrapping wheel, assembled so as to turn round an essentially horizontal axis and designed to receive, one after the other, at an input or loading station, die-cut pieces and, at the same time, preformed groups of cigarettes usually consisting of twenty cigarettes wrapped in silver foil. Each of the said die-cut pieces is fed by the wrapping wheel through a series of folding stations where the die-cut piece is gradually folded round the group of cigarettes garettes to form an outer case having the shape of a parallelepipedon provided with larger front and back parallel faces and smaller parallel side faces.

The last folding operation each die-cut piece is subjected to consists in bending two side tabs, which define an outer layer of said smaller side faces, when the packet is unloaded radially, with its front face first, off the folding wheel through a calibrated opening.

On the above known machine, the packets coming off the folding wheel are sent to an output unit comprising a first so-called "reject" wheel, a second so-called "drying" wheel and an output conveyor. The said reject and drying wheels are assembled so as to turn round vertical axes and arranged with one partially overlapping the other so that the packets can be transferred from one to the other moving parallel to the said rotation axes. On the above known packing machine, the reject wheel is arranged tangent to the said folding wheel, slightly below the drying wheel, and comprises a drum turning between two fixed axial plates for defining axially a number of radial cavities on the said drum, each of the said cavities being designed to accommodate a packet loaded by a device, which unloads each finished packet radially off the folding wheel through the aforementioned calibrated opening, and with its smaller side faces arranged horizontally; then rotates the packet by 90° about a vertical axis, and finally pushes the packet, with a top or a bottom face first, into a respective cavity of the drying wheel. Each packet is, therefore, finally arranged within the respective cavity of the drying wheel with its larger front and back faces in contact with the lateral side faces of the respective cavity, and with its smaller side faces facing the top and the bottom axial plate respectively. The bottom axial plate has an opening through which faulty packets are unloaded by an axial push mechanism, whereas the top axial plate has an opening for transferring the packets axially to the drying wheel. Obviously, in view of the said opening in the bottom plate, the packets being fed forward by the reject wheel are not supported by the bottom plate but by friction between the front and rear faces of each packet and the side faces of the relative cavity. Consequently, the sides of each packet, which are the last to be folded and stuck when leaving the folding wheel, are in no way held down by contact with the said top and bottom plates. On the contrary, they are pushed outwards by the pressure applied on the front and rear face of each packet. In addition to this drawback, the overlapping arrangement of the reject and drying wheels prevents easy access to the parts transferring the packets axially and arranged between the said two wheels. Finally, the horizontal arrangement of the drying wheel, the function of which is to ensure thorough drying of the glue used on the folding wheel for joining the overlapping parts on the die-cut piece, involves the use of a bottom axial plate on the drying wheel for supporting the packets. The said plate, being provided with an axial opening for axial input of the packets fed off the reject wheel, is fixed at an angle, so that the packets are forced to slide forward over the bottom plate with the risk of being damaged.

SUMMARY OF THE INVENTION

The aim of the present invention is to provide a machine for packing cigarettes in hard, flip-top packets which involves none of the aforementioned drawbacks. With this aim in view, the present invention relates to a machine for packing cigarettes in hard, flip-top pack ets, the said machine comprising a folding wheel, with a horizontal rotation axis, for feeding, one after the other, a number of groups of cigarettes and relative die-cut pieces through a number of folding stations for folding the said die-cut pieces round the said relative groups; an output unit comprising drying and reject means and an output conveyor; and transferring means for unloading the said packets radially off the said wheel and transferring them to the said output unit; characterised by the fact that the said drying and reject means comprise at least a first wheel with a horizontal rotation axis, the said output unit defining, in conjunction with the said folding wheel, a structure essentially in the form of a U when viewed from above.

BRIEF DESCRIPTION OF THE DRAWINGS

The invention will now be described with reference to the attached drawings showing two non-limiting arrangements of the present invention and in which.

DETAILED DESCRIPTION OF THE INVENTION

Figure 1:
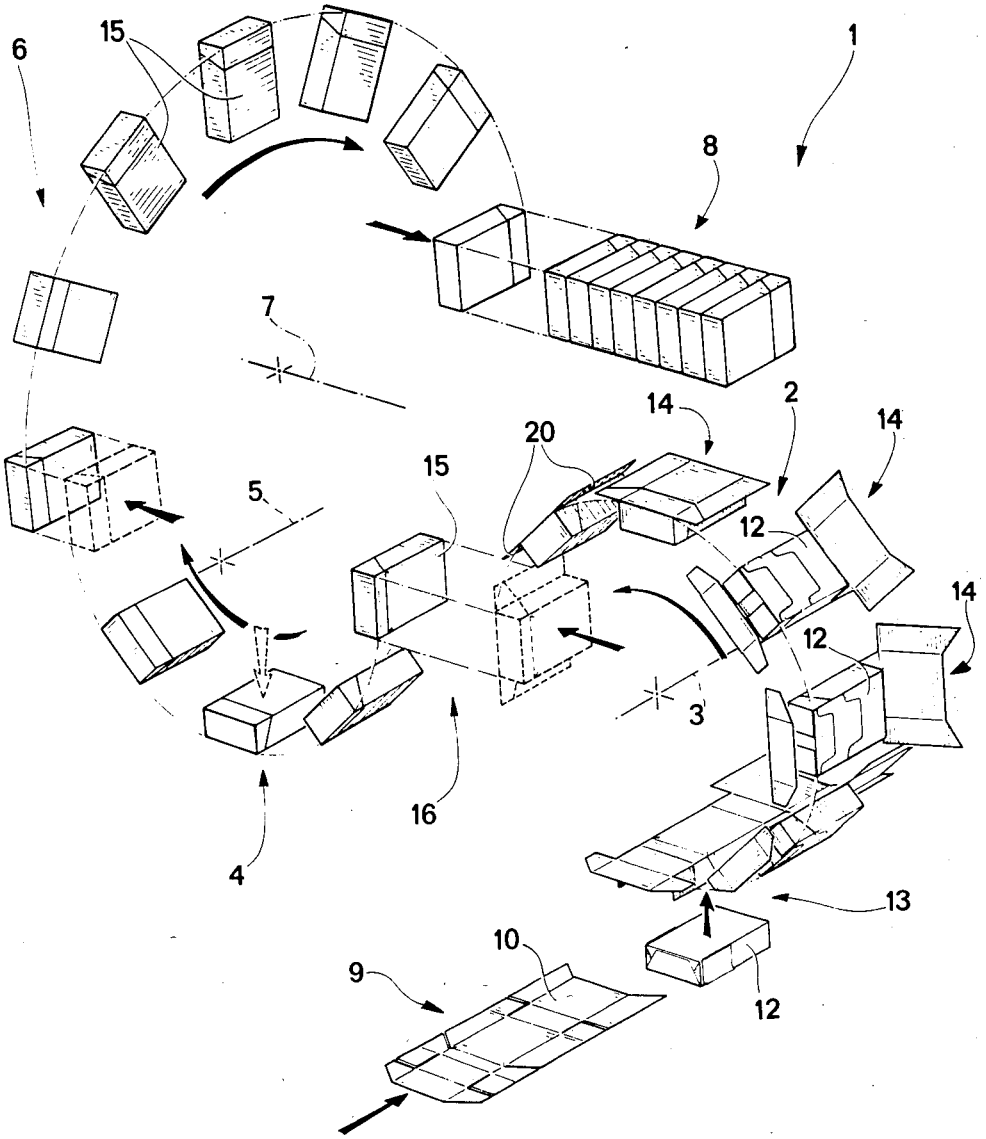
FIG. 1 shows a view in perspective of the end of a wrapping line on a cigarette packing machine according to the present invention.

FIG. 1 shows a part view of a cigarette packing machine, indicated as a whole by number 1, the end of the wrapping line on which comprises a wrapping wheel (2), assembled so as to turn round a first horizontal rotation axis (3), a reject means comprising a reject wheel (4) essentially tangent to wrapping wheel 2 and assembled so as to turn round a second horizontal rotation axis (5) parallel to axis 3, a drying means comprising a drying wheel (6) assembled so as to turn round a third horizontal rotation axis (7) perpendicular to axes 3 and 5 and essentially tangent to reject wheel 4, and an essentially horizontal output conveyor (8) extending essentially parallel to axis 7 and arranged on the same side as wheels 2 and 4 in relation to drying wheel 6, so as to render the wrapping line on packing machine 1 essentially U-shaped in the horizontal plane.

The unit consisting of the said wheels 4 and 6 and conveyor 8 will hereinafter also be referred to as the output unit.

Wrapping wheel 2 is fed, one by one, by a conveyor (9), the axis of which is essentially parallel to axis 3, with die-cut pieces 10, each of which is loaded radially inside a radial cavity or slot (11) on wheel 2, together with a group of cigarettes (12) usually in the shape of a rectangular parallelepipedon and usually consisting of twenty cigarettes arranged in three rows (not shown) and wrapped in silver foil.

Figure 2:
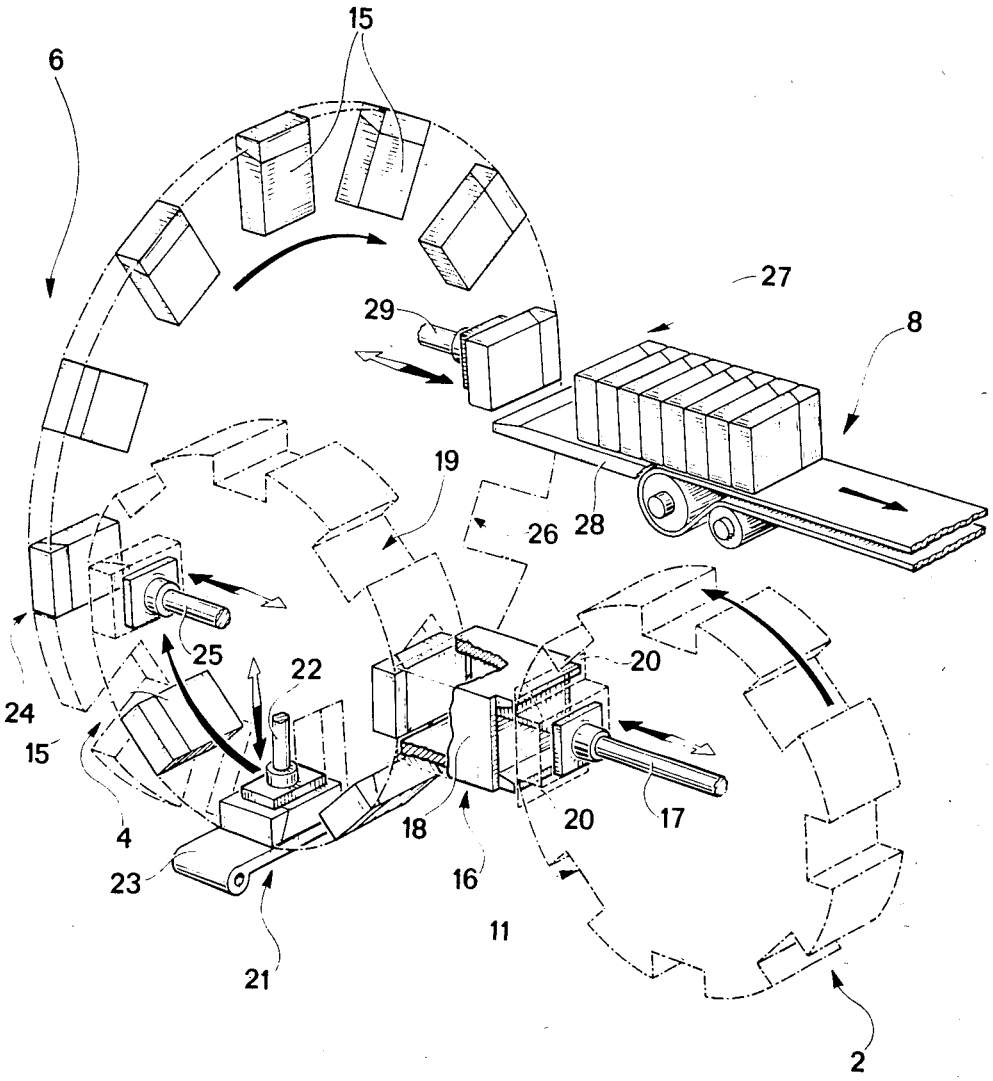
FIG. 2 shows a view in perspective of a detail in FIG. 1.

As it moves forward on wrapping wheel 2, each die-cut piece (10) is fed, starting from a loading station indicated as a whole by number 13, through a number of fold ing stations (14) in which it is gradually folded round a group of cigarettes (12) and stuck down using glue supplied by gluing fixtures now shown in the drawing. Each die-cut piece 10, when it reaches an output or loading station 16, is folded about its group of cigarettes 12 to form a packet 15 having a substantially finished outer case shaped as a parallelepipedon with larger front and back faces and smaller side faces. At station 16, as shown in FIG. 2, each packet 15, resting inside cavity 11 with its front face arranged vertically and facing outwards and its smaller side faces arranged horizontally, is pushed out radially off wheel 2, by a push mechanism or transfer means (17), through a calibrated rectangular opening through spindle 18 into a radial cavity or slot (19) on reject wheel 4. In FIG. 1, wheels 2 and 4 are obviously turned anticlockwise and clockwise respective ly by a step feed device (not shown) and packets 15 trans ferred by one wheel to the other when the wheels are stationary.

As shown in FIG. 2, the last folding operation performed on die-cut piece 10 is the folding back of two side tabs (20) as the packet moves through spindle 18. As shown in FIG. 2, once it has been transferred on to wheel 4 at the loading point on spindle 18, each packet (15) is fed by wheel 4 in a direction substantially perpendicular to its smaller side faces and reject station 21 through a reject station (21) where a push mechanism (22), the axis of which is perpendicular to axis 5, operates in conjunction with an external mobile supporting element (23) for expelling radially from cavities 19 any packets found to be faulty by detector units (not shown) fitted upstream from wheel 2. Reject wheel 4 then feeds packets 15 one by one to a transfer station or point (24) where a push mechanism or transfer means (25) expels packets 15 radially from cavities 19 and feeds them, parallel to axis 7, with their rear faces forward, into radial slots or cavities 26 round drying wheel 6.

In FIG. 1, wheel 6 is driven clockwise round its own axis (7) by the said step feed device (not shown) so as to advance packets 15 in a direction perpendicular to their smaller side faces, and transfer them from station 24 to an unloading or storage station (27). As they move along step by step between stations 24 and 27, packets 15 may, if necessary, be subjected to a source of heat (not shown) for ensuring thorough drying of the glue used for sticking together the bent overlapping parts on die-cut pieces 10. Generally speaking, however, this does not prove necessary, if relatively fast-drying glues are used. If this is the case, the sole function of drying wheel 6 is to transfer packets 15 between reject wheel 4 and conveyor 8 arranged side by side and parallel to each other. Unloading or storage station 27 comprises a flat plate (28), in line with output conveyor 8, and a push mechanism (29), which moves over plate 28 parallel to axis 7 and through the axes of slots 26 which align with plate 28 whenever wheel 6 stops. When push mechanism 29 is activated, packets 15 are pushed out of slots 26 and fed one by one on to plate 28 with their front faces forward in the feed direction of conveyor 8 and one of side tabs 20 sliding against the top face of plate 28. From the above description, it will be clear that one of the major advantages of the packing machine (1) described consists in enabling packets 15 to be fed by wheels with horizontal rotation axes, which not only retain packets 15 by pressing down on the outer face of side tabs 20, thus keeping the said tabs firmly in place until the glue used for connecting them has dried thoroughly, but also eliminate the need for fitting the said wheels with axial container plates in sliding contact with the packets. A further advantage of the machine (1) described consists in the fact that the said wheels 4 and 6 no longer overlap each other partially, thus providing for easy access to any device fitted between them and/or to the packets carried on them.

Furthermore, the U arrangement of wheels 2, 4 and 6 and conveyor 8 enables all the said parts to be arranged round one end of machine 1, thus providing for both compactness and easy access.

Figure 3:
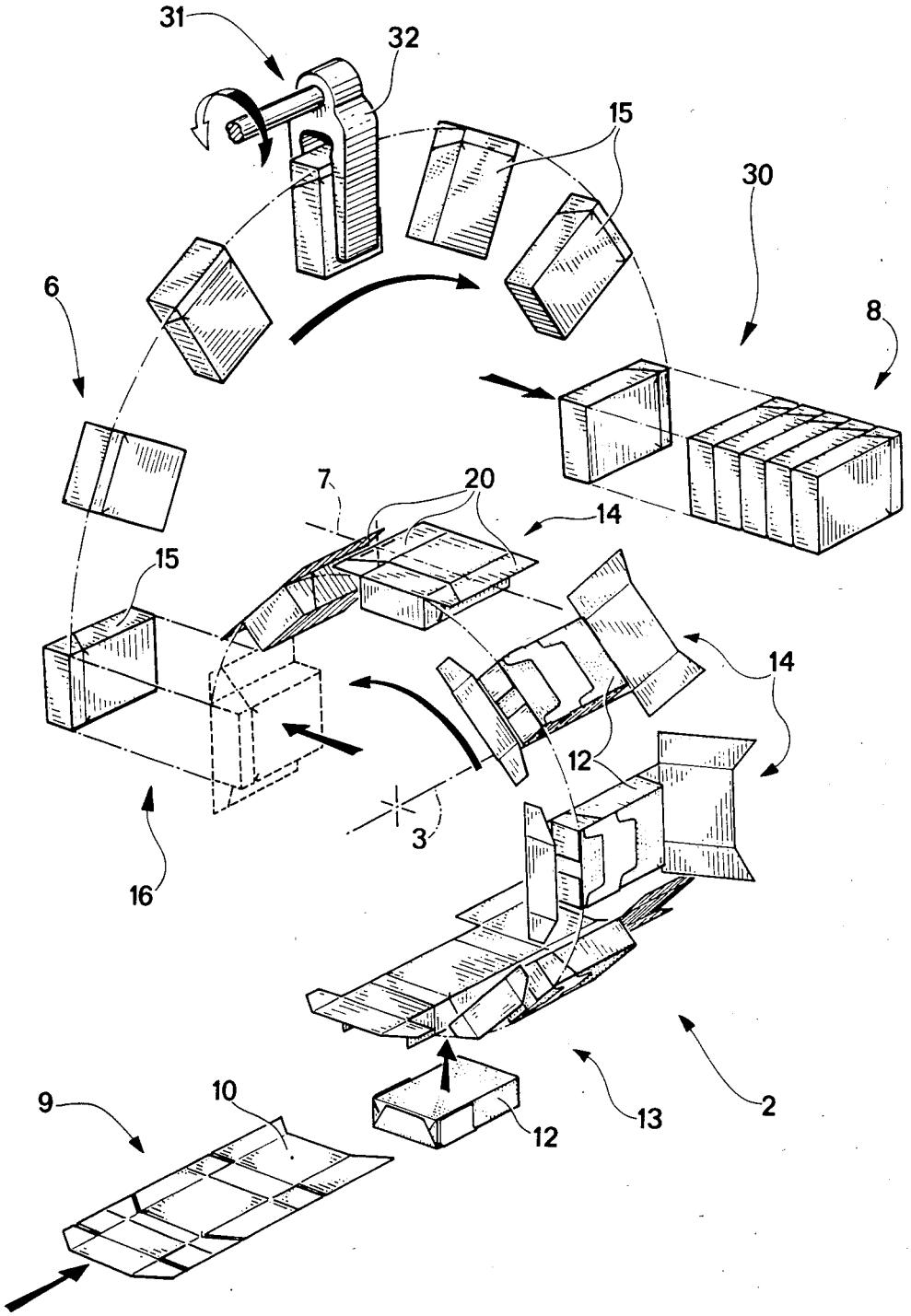
FIG. 3 shows a variation of the packing machine in FIG. 1.

Finally, using wheels with only horizontal axes simplifies wheel automation to an enormous extent, besides making machine 1 more compact and more reliable. The FIG. 3 variation shows a packing machine (30) identical to machine 1 except that it has no reject wheel (4). In this case, the packets (15) pushed out of cavities 11 on folding wheel 2 by push mechanism 17 are fed, through spindle 18, straight into cavities 26 on wheel 6 which, in this case, is arranged essentially tangent to the outer edge of wheel 2 itself.

As no reject wheel (4) is provided, any faulty packets are rejected at reject station 31 on drying wheel 6, the said station comprising a rocking fork (32) astride the outer edge of wheel 6 itself.

I claim:

1. A machine for packing cigarettes is hard fliptop packets, each including a die-cut piece folded to form a parallelepipedon case having larger front and back faces and smaller side faces; the machine comprising:

a rotary folding wheel mounted for rotation about a horizontal axis and for folding in succession said diecut pieces about respective groups of cigarettes to form said packets;

an output unit;

transfer means to push in succession each said packet off said folding wheel in a radial outwards sense which is perpendicular to said larger front and back faces of said packet, and to transfer said packet to said output unit;

said output unit comprising means for drying said packets, means for rejecting those of said packets which are faulty, and an output conveyor; and said drying and said rejecting means comprising at least one rotary conveyor wheel substantially tangent, in a radial direction, to the periphery of said folding wheel, and mounted for rotation about a substantially horizontal axis to convey each said packet towards said output conveyor in a direction substantially perpendicular to said smaller side faces of the packet itself.

2. A machine according to claim 1 wherein the axis of rotation of said at least one conveyor wheel is perpendicular to the axis of rotation of said folding wheel.

3. A machine as claimed in claim 2 wherein the axis of rotation of said folding wheel and the axis of rotation of each said conveyor wheel are coplanar with each other.

4. A machine as claimed in claim 2 wherein said output conveyor extends from the periphery of said conveyor wheel with the axis of rotation of the conveyor wheel being perpendicular to the axis of rotation of said folding wheel; and said output conveyor extends in a direction perpendicular to the axis of rotation of said folding wheel and in a sense opposite to said outwards radial sense.

5. A machine as claimed in claim 1 wherein said drying and said rejecting means comprise two rotary conveyor wheels;

a first of said rotary conveyor wheels being coplanar with, and substantially tangent to the periphery of, said folding wheel and being mounted for rotation about a horizontal axis parallel to the axis of rotation of said folding wheel; and a second of said rotary conveyor wheels being substantially tangent to the periphery of said first conveyor wheel and being mounted for rotation about a horizontal axis perpendicular to the axis of rotation of said folding wheel.

6. A machine as claimed in claim 5 wherein the axis of rotation of said folding wheel and the axis of rotation of each said conveyor wheel are coplanar with each other.

7. A machine as claimed in claim 5 wherein said output conveyor extends from the periphery of said conveyor wheel with the axis of rotation of the conveyor wheel being perpendicular to the axis of rotation of said folding wheel; and said output conveyor extends in a direction perpendicular to the axis of rotation of said folding wheel and in a sense opposite to said outwards radial sense.

8. A machine as claimed in claim 1, wherein each said conveyor wheel of said drying and rejecting means is provided with a plurality of equally spaced peripheral radial slots each defining a conveying recess for a respective said packet, and each having, relative to its sense of advancement, lateral forward and back inner surfaces cooperating with said smaller side faces of said packet.

* * * * *